United States Patent [19]

Kiritani et al.

[11] Patent Number: 4,665,411

[45] Date of Patent: May 12, 1987

[54] HEAT-SENSITIVE RECORDING MATERIAL

[75] Inventors: Masataka Kiritani; Toshimasa Usami; Toshiharu Tanaka, all of Shizuoka, Japan

[73] Assignee: Fuji Photo Film Co., Ltd., Kanagawa, Japan

[21] Appl. No.: 734,644

[22] Filed: May 16, 1985

[30] Foreign Application Priority Data

May 16, 1984 [JP] Japan ..... 59-97793

[51] Int. Cl.[4] ..... B41M 5/18

[52] U.S. Cl. ..... 346/213; 346/208; 346/209; 346/217; 346/218; 427/150; 427/151; 430/138; 430/151

[58] Field of Search ..... 346/200, 205, 206, 209, 346/213, 216–218, 225, 208, 214, 215; 427/150–152; 430/138, 151, 176, 177

[56] References Cited

U.S. PATENT DOCUMENTS

| | | | |
|---|---|---|---|
| 3,202,510 | 8/1965 | Hollman | 430/138 |
| 4,400,456 | 8/1983 | Matsuda et al. | 430/138 |
| 4,529,681 | 7/1985 | Usami et al. | 430/138 |

FOREIGN PATENT DOCUMENTS

| | | | |
|---|---|---|---|
| 2233183 | 1/1973 | Fed. Rep. of Germany | 346/217 |
| 0187294 | 11/1982 | Japan | 346/217 |
| 0083842 | 5/1983 | Japan | 346/217 |

*Primary Examiner*—Bruce H. Hess

*Attorney, Agent, or Firm*—Sughrue, Mion, Zinn, Macpeak & Seas

[57] ABSTRACT

A heat-sensitive recording material is described, comprising a recording layer containing a diazo compound and a coupling component provided on a support, wherein one of said diazo compound and said coupling component is contained in microcapsules together with an organic solvent having a dielectric constant of from 5.2 to 7.5.

8 Claims, No Drawings

HEAT-SENSITIVE RECORDING MATERIAL

FIELD OF THE INVENTION

The present invention relates to a heat-sensitive recording material, and more particularly to a heat-sensitive recording material which not only has a superior property of storage before thermal recording but also high color-forming density in thermal recording and which is photo-fixable after thermal recording.

BACKGROUND OF THE INVENTION

Heat-sensitive recording methods have advantages such as that (1) development is unnecessary, (2) when paper is selected as a support, the paper quality may be close to that of an ordinary paper, (3) handling is easy, (4) the colored images of high density is provided, (5) a recording apparatus is inexpensive because of its simple structure, and (6) no noise is generated in recording. Accordingly, recently use of heat-sensitive recording methods has rapidly spread in the fields of facsimile and printers. As such a heat-sensitive recording material used for the method, mainly a heat-sensitive recording material of the leuco color-forming type exhibiting desirable coloration density and color-forming speed has been used. In the heat-sensitive recording material of the leuco color-forming type, however, there is a disadvantage in that the material also tends to form color due to handling after recording, due to heating, or due to adhering of a solvent or the like so that a recording image becomes dirty in appearance.

As a method of preventing such undesired color-formation after thermal recording, a method is known as disclosed by Japanese Patent Application (OPI) Nos. 123086/82 and 125092/82 (corresponding to U.S. Pat. No. 4,411,979), U.S. Pat. No. 3,281,244, and so on (the term "OPI" as used herein refers to a "published unexamined Japanese patent application), in which after thermal recording has been made by using a heat-sensitive recording material composed of a diazo compound, a coupling component and an alkali-generating agent or a coloring assistant, irradiation is performed so as to decompose unreacted diazo compound to stop the color forming. In this method, however, there is a disadvantage in that precoupling gradually progresses during storage (i.e., storage before use) of such a recording material so as to generate undesirable coloration or fog.

As a method of preventing such fog, a method has been proposed in which either one of the coupling component and the coloring assistant is encapsulated by using a nonpolar wax-like material (Japanese Patent Application (OPI) Nos. 44141/82 and 142636/82) or by using a hydrophobic polymeric material (Japanese Patent Application No. 192944/82), so that the material in a capsule is separated from the other components. In these encapsulating methods, however, a microcapsule is formed such that the wax or the polymeric material is dissolved by its solvent and then the color forming component is dissolved or dispersed in the solution and thereafter the solvent is evaporated to be eliminated.

In these encapsulating methods, however, the color forming components are not entirely encapsulated as core materials of the microcapsules, and some of the color forming components are uniformly mixed with the microencapsulating materials, with the result that precoupling is gradually progresses at the wall interfaces of the microcapsules during storage, and therefore a shelf storage property (storability) is not satisfactory.

Since a color-forming reaction is generated only when walls of the microcapsules have been thermally fused, the thermal color-forming property is lowered. Further there is such a problem in preparation in that the wax or the polymeric material must be removed after the microcapsules have been formed and therefore the encapsulating methods are not satisfactory.

SUMMARY OF THE INVENTION

A first object of the present invention is therefore to provide a heat-sensitive recording material having a superior shelf storage, a high color-forming speed, and a high coloration density.

A second object of the present invention is to provide a heat-sensitive recording material in which photolysis of an unreacted diazo compound is performed after thermal recording and color formation in undesired portions can be stopped (hereinafter referred to as "fixing").

A third object of the present invention is to provide a heat-sensitive recording material having a superior adaptability for production.

A fourth object of the present invention is to provide a heat-developing recording material in which a diazo compound in an exposure portion is decomposed by photo recording and thereafter an unexposed portion is colorformed by heating so as to form a visible image.

As a result of extensive investigation, the present inventors have achieved the objects of the present invention by a heat-sensitive recording material comprising a recording layer containing a diazo compound and a coupling component provided on a support, wherein one of said diazo compound and said coupling component is contained in microcapsules together with an organic solvent having a dielectric constant of from 5.2 to 7.5.

DETAILED DESCRIPTION OF THE INVENTION

Differing from the conventional recording material in which a microcapsule is broken by heat or a pressure so that a reactive material contained in the core of the microcapsule and the other reactive material existing outside the microcapsule are caused to come into contact so as to generate a color-forming reaction, according to the present invention, the reactive materials existing in the core of the microcapsule and outside the microcapsule undergo a color-forming reaction therebetween by allowing them to permeate through the wall of the microcapsule by application of heat. In this case, if a solvent having a dielectric constant of 5.2 to 7.5 coexists with the reactive materials, not only is color-forming fog during storage considerably decreased, but color forming speed as well as coloration density are made very high.

When a solvent having a dielectric constant lower than 5.2 is used, not only can the diazo compound not be entirely dissolved (thus partly remain in the undissolved state), but also the color-forming fog becomes large. When the dielectric constant is larger than 7.5, high contrast can not be obtained because the color-forming fog becomes large even though the coloration density becomes high. It is preferable to use a solvent having a dielectric constant of from 5.5 to 7.4, and most preferably from 6 to 7.

According to the present invention, it is preferable that the reactive materials, that is, the diazo compound and the coupling component which form the core material is dissolved or dispersed in an organic solvent and thereafter the core material containing the reactive material and the organic solvent are microencapsulated with a wall material produced through a polymerization process such as interfacial polymerization, an external polymerization, an internal polymerization, or the like. The wall material is preferably selected from polyurethane, polyurea, polyamide, and polyester.

In the case where such a microencapsulating method as disclosed by Japanese Patent Application (OPI) No. 192944/82 is used (in which an already polymerized thermal-softening polymer, such as vinyl polymer, is used as the raw material of the wall so as to form a microcapsule by the precipitation of the polymer from the organic solvent), there arises a problem in that the heat-sensitive recording material obtained is not satisfactory because of excessive fog.

On the other hand, in the case where the microencapsulating method disclosed by Japanese Patent Application (OPI) No. 192944/82 in which the core material is composed of only a reactive material, not only is fog not improved, but also the color forming speed and the coloration density are lowered so that an improved heat-sensitive recording material can not be obtained.

In the case where the three kinds of materials, that is, the diazo compound, the coupling component, and the coloring assistant were contained together with the organic solvent in the same microcapsules, the recording material obtained can not be practically used because of color fog formation.

According to the present invention, the organic solvent used in the core material is a water insoluble solvent having a dielectric constant of from 5.2 to 7.5.

Some specific examples are illustrated hereunder. The numeral in parentheses designates the value of a permittivity or dielectric constant measured at 10 KHz and 20° C. Dibutyl phthalate (6.4), tricresyl phosphate (7.3), diphenylcresyl phosphate (7.3), monochloro terephthalic dibutyl ester (6.5),

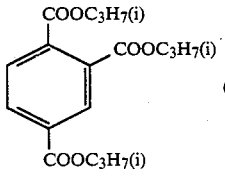

(7.0),

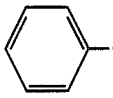

(5.78),

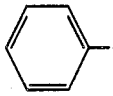

(6.5),

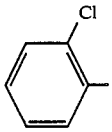

(5.8),

-continued

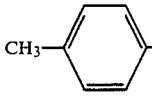

(5.9),

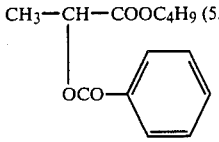

(5.9),

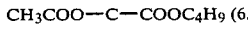

(6.0),

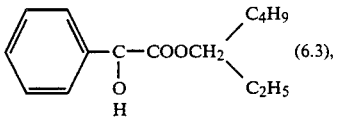

(6.3),

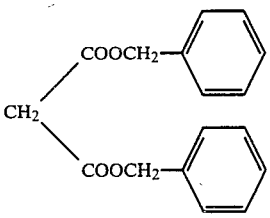

(6.1)

and, $CH_3COCH_2COOC_{12}H_{25}$ (6.4). Also the solvent in which two or more kinds of organic solvents are mixed with together and the dielectric constant is adjusted to be 5.2 to 7.5 may be used. For example, a good result can be obtained by using a solvent (5.5) which is made by mixing with tricresyl phosphate (7.3) and trimethylolpropane trimethacrylate (4.9) at a weight ratio of 3 to 1.

The diazo compounds used according to the present invention are diazonium salts represented by the formula $ArN_2^+X^-$ (in which Ar represents a substituted or non-substituted moiety, $N_2^+$ represents a diazonium group and $X^-$ represents an acid anion), and the compound can be reacted to perform color-forming together with the coupling component and can be decomposed by irradiation.

Specific examples of the diazonium forming the diazonium salt include the following: 4-diazo-1-dimethylaminobenzene; 4-diazo-1-diethylaminobenzene; 4-diazo-1dipropylaminobenzene, 4-diazo-1-methylbenzylaminobenzene; 4-diazo-1-dibenzylaminobenzene; 4-diazo-1-ethylhydroxyethylaminobenzene; 4-diazo-1-diethylanino-3-methoxybenzene; 4-diazo-1-dimethylamino-2-methylbenzene; 4-diazo-1-benzoylamino-2,5-diethoxybenzene; 4-diazo-1-morpholinobenzene; 4-diazo-1-morpholino-2,5-diethoxybenzene; 4-diazo-1-morpholino-2,5-dibutoxybenzene; 4-diazo-1-anilinobenzene; 4-diazo-1-toluylmercapto-2,5-diethoxybenzene; 4-diazo-1,4-methoxybenzoylamino-2,5-diethoxybenzene; etc.

Specific examples of the acid anion include the following: $C_nF_{2n+1}COO^-$ (n represents an integer 3 to 9); $C_mF_{2m+1}SO_3^{31}$ (m represents an integer of 2 to 8); $(C_lF_{2l+1}SO_2)_2CH^-$ (l represents an integer of 1 to 18);

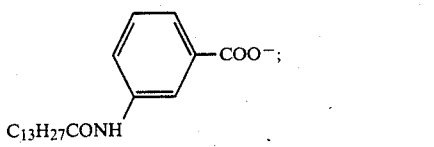

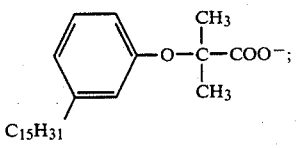

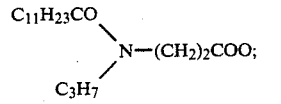

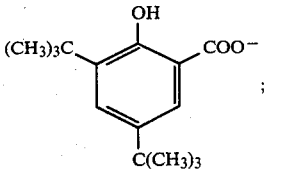

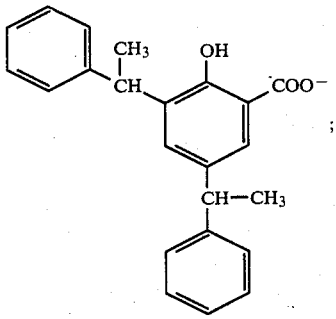

$BF_4^-$; $PF_6^-$; etc.

Specific examples of the diazo compound (that is, the diazonium salt) include the following:

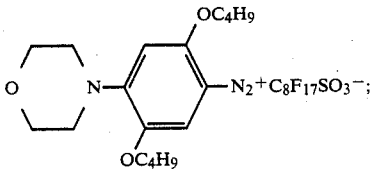

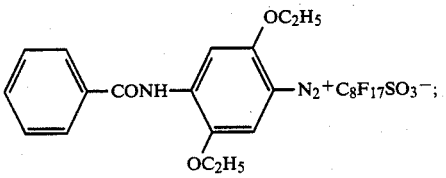

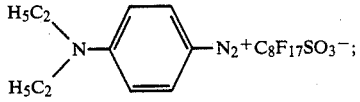

-continued

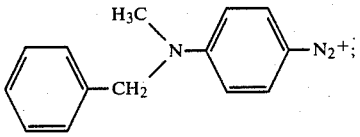

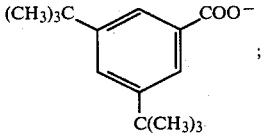

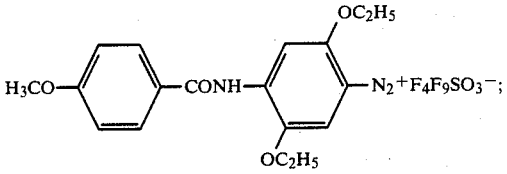

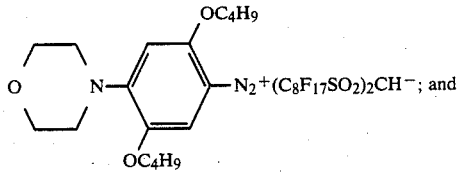

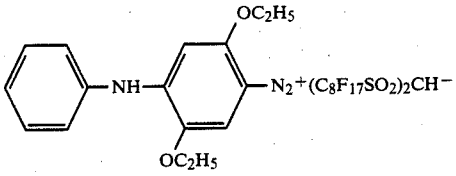

The coupling component used according to the present invention is a compound which forms a dye by coupling with the diazo compound (that is, the diazonium salt) under basic conditions. Specific examples include the following: resorcin; phloroglucin; sodium 2,3-dihydroxynaphthalene-6-sulfonate; 1-hydroxy-2-naphthoic acid morpholinopropylamide; 1,5-dihydroxynaphthalene, 2,3-dihydroxynaphthalene; 2,3-dihydroxy-6-sulfanylnaphthalene; 2-hydroxy-3-naphthoic acid morpholinopropylamide; 2-hydroxy-3-naphthoic acid-anilide; 2-hydroxy-3-naphthoic acid-2'-methylanilide; 2-hydroxy-3-naphthoic acid-ethanolamide; 2-hydroxy-3-naphthoic acidoctylamide; 2-hydroxy-3-naphthoic acid-N-dodecyloxypropylamide; 2-hydroxy-3-naphthoic acid-tetradecylamide; acetanilide; acetoacetanilide; benzoylacetanilide; 1-phenyl-3-methyl-5-pyrazolone; 1-(2',4',6'-trichlorophenyl)-3-benzamide-5-pyrazolone; 1-(2',4',6'-trichlorophenyl)-3-anilino-5-pyrazolone; 1-phenyl-3-phenylacetoamide-5-pyrazolone; etc. Further, a colored image of a desired color tone can be obtained by simultaneously using two or more kinds of the coupling components.

According to the present invention, as a coloring assistant, if desired, a basic material which is slightly soluble or which is insoluble in water, or a material capable of producing an alkali by heating, is used.

The coloring assistant may be a compound containing nitrogen such as inorganic and organic ammonium salts, organic amines, amides, ureas and their derivatives, thiourea, and their derivatives, thiazoles, pyrroles, pyrimidines, piperazines, guanidines, indoles, imidazoles, imidazolines, triazoles, morpholines, piperidines, amidines, formamidines, pyridines and the like. Specific examples thereof include the following: ammonium acetate; tricyclohexylamine; tribenzyl amine; octadecylbenzylamine; stearylamine; allylurea; thiourea; methylthiourea; allylthiourea; ethylenethiourea; 2-benzylimidazole; 4-phenylimidazole; 2-phenyl-4-methylimidazole; 2-undecyl-imidazoline; 2,4,5-trifuryl-2-imidazoline; 1,2-diphenyl-4,4-dimethyl-2-imidazoline; 2-phenyl-2-imidazoline; 1,2,3-triphenylguanidine; 1,2-ditollylguanidine; 1,2-dicyclohexylguanidine; 1,2,3-tricyclohexylguanidine; guanidine trichloroacetate; N,N'-dibenzylpyperazine; 4,4'-dithiomorpholine; morpholinium trichloroacetate; 2-aminobenzothiazole; 2-benzoylhydrazinobenzothiazole; etc. Also two or more kinds of the coloring assistants can be used with together.

The microcapsule according to the present invention is produced in such a manner that after the core material has been emulsified, a wall of a polymeric material is formed around the individual oil droplets of the emulsified material by the polymerizing reaction. Reactant forming the polymeric material is added to the inside and/or the outside of the oil droplets. Specific examples of the polymeric material include polyurethanes, polyureas, polyamides, polyesters, polycarbonates, urea-formaldehyde resins, melamine resins, polyvinylacetals, etc.

Also, two or more kinds of polymeric materials can be used together. The polymer can be formed using, preferably, polyurethanes, polyureas, polyamides, polyesters and polycarbonates, and more preferably, polyurethanes and polyureas.

Further, the diazo compound, the coupling component, and the coloring assistant can be respectively contained in individual microcapsules, and this is the best mode from the viewpoint of preventing color fog. In this case, it is necessary to make one of the diazo compound and coupling component among the components as described above exist in the microcapsules together with the organic solvent. Among all, the most preferable result can be obtained in the case where the diazo compound is contained in microcapsules together with the organic solvent.

As the method of forming the wall of the microcapsule according to the present invention, the largest effect can be obtained when the particular method used for performing the microencapsulating is by polymerization of the reactant from the inside of the oil droplets. That is, it is possible to obtain, for a short time, capsules which have a uniform particle diameter and a superior shelf storage, and which are superior as the recording material.

This microencapsulating method and particular examples of the compound used are disclosed in the specifications of U.S. Pat. Nos. 3,726,804 and 3,796,669.

For example, when the polyurethane is used as the wall material of the capsule, polyvalent isocyanate and a second material, for example, polyol, which reacts with the polyvalent isocyanate so as to form the wall of the capsule, are mixed with each other in an oil solution to be encapsulated, and then emulsified to be dispersed in the water. Next, the temperature is raised so that the polymer-forming reaction is started in the interface of the oil droplets so as to form the wall of the microcapsule. At this time, an auxiliary solvent having a low boiling point and a strong dissolving power can be used in the oil solution.

The polyisocyanates, and the mating polyols or polyamines to be reacted with the polyisocyanates are disclosed in U.S. Pat. Nos. 3,281,383, 3,773,695, and 3,793,268; Japanese Patent Publication Nos. 40367/73 and 24159/74 (corresponding to British Pat. No. 1,127,338 and U.S. Pat. No. 3,723,363, respectively); and Japanese Patent Application (OPI) Nos. 80191/73 and 84086/73 (corresponding to U.S. Pat. No. 3,838,108 and British Pat. No. 1,416,224, respectively), and these materials may be also used.

The process of preparing a capsule wall of the present invention is not limited to the above-described processes. All polymeric substances formed by the reaction of polyvalent isocyanate and polyol are preferably used as a capsule wall of the present invention.

Specific examples of polyvalent isocyanate include diisocyanates such as m-phenylenediisocyanate, p-phenylene-diisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyl-diisocyanate, 3,3'-dimethyldiphenylmethane-4,4'-diisocyanate, xylylene-1,4-diisocyanate, 4,4'-diphenylpropanediisocyanate, trimethylenediisocyanate, hexamethylenediisocyanate, propylene1,2-diisocyanate, butylene-1,2-diisocyanate, cyclohexylene1,2-diisocyanate, cyclohexylene-1,4-diisocyanate and so on; triisocyanates such as 4,4',4''-triphenylmethanetriisocyanate, toluene-2,4,6-triisocyanate and so on; tetraisocyanates such as 4,4'-dimethyldiphenylmethane-2,2',5,5'-tetraisocyanate and the like; and isocyanate prepolymers such as a hexamethylenediisocyanate-trimethylolpropane addition product, a 2,4-tolylenediisocyanate-trimethylolpropane addition product, a xylylenediisocyanate-trimethylolpropane addition product and a tolylenediisocyanate-hexanetriol addition product.

Specific examples of polyols include those made of aliphatic and aromatic polyhydric alcohols, hydroxypolyesters, hydroxypolyalkylene ethers, and the like. Preferred polyols are polyhydroxy compounds including the partial structure (I), (II), (III), or (IV) between two hydroxy groups in the molecular structure, and having a molecular weight of 5,000 or less.

(I) an aliphatic hydrocarbon residue containing from 2 to 8 carbon atoms (II)

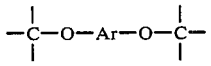

(III)

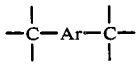

(IV)

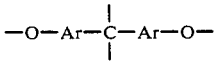

In structures (II), (III), and (IV), Ar represents a substituted or unsubstituted aromatic moiety, and the aliphatic hydrocarbon residue of (I) contains a moiety of the formula $-C_nH_{2n}-$ as a basic skeleton, a hydrogen of which may be substituted with another element. Specific examples of polyols comprising (I) include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, phenylethylene glycol, 1,1,1-trimethylolpropane, hexanetriol, pentaerythritol, glycerine, and so on.

Specific examples of polyols comprising (II) include condensation products of aromatic polyhydric alcohols, such as 1,4-di(2-hydroxyethoxy)benzene, resorcinol dihydroxyethyl eother, etc., and alkylene oxides.

Specific examples of polyols comprising (III) include p-xylylene glycol, m-xylylene glycol, $\alpha,\alpha'$-dihydroxy-p-diisopropylbenzene, and the like.

Specific examples of polyols comprising (IV) include 4,4'-dihydroxydiphenylmethane, 2-(p,p'-dihydroxydiphenylmethyl)benzyl alcohol, a bisphenol A-ethylene oxide addition product, a bisphenol A-propylene oxide addition product, and so on.

It is desirable to use polyols in such an amount that 0.02 to 2 moles of hydroxy group per 1 mole of isocyanate group may be present in starting the reaction.

Specific examples of the polyamine, which can be used instead of the polyol, include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, an amine adduct of epoxy resin, etc.

Further, the polyvalent isocyanate is able to form a polymeric substance as a preferred capsule wall by the reaction with water.

If other conditions are maintained unchanged, the wall thickness can be varied by changing an additive amount of polyisocyanate, polyol, or polyamine. If other conditions are maintained unchanged, the particle size, and therefore the wall thickness, can be varied by changing the state of agitation in emulsifying/dispersing.

When the microcapsule is prepared, a water soluble polymers can be used for the purpose of emulsifying or preventing the emulsified material from cohering. Useful water soluble polymers include water soluble anionic polymers, nonionic polymers, and amphoteric polymers. The anionic polymer may be natural or synthetic, and may have, for example, a $-COO^-$ group, a $-SO_3^-$ group, or the like. Examples of natural anionic polymers include gum arabic, alginic acid, etc. Semisynthetic anionic materials include carboxymethyl cellulose, phthaloylated gelatin, sulfonated starch, sulfonated cellulose, lignin sulfonic acid, etc.

Examples of the synthetic anionic materials include a maleic anhydride copolymer (hydrolyzed materials are also contained), an acrylic acid homo- or co-polymer (those of methacrylic acid is also contained), a vinylbenzene sulfonic acid homo- or co-polymer, carboxy-denatured polyvinyl alcohol, etc.

Examples of nonionic polymers include polyvinyl alcohol, hydroxyethyl cellulose, methyl cellulose, etc.

As the amphoteric compound, gelatin, or the like, can be employed.

The water soluble polymer can be used in the form of a 0.01 to 10 wt % aqueous solution. The particle size (average diameter) of the microcapsules is regulated to be 20 μm or less. Generally, when the particle size is larger than 20 μm, the quality of the printed images tends to suffer deterioration.

Particularly, when heat application by a thermal head is effected from the coated layer side, it is preferable to select the particle diameter not larger than 8 μm to prevent pressure fog from occurring.

Microcapsules may be formed from the emulsification solution containing the components to be microencapsulated in a concentration of 0.2 wt % or more.

It is preferable to select the amounts of the coupling components and the coloring assistant relative to the diazo compound to be from 0.1 to 10 weight parts of the coupling component and from 0.1 to 20 weight parts of the coloring assistant per 1 weight part of the diazo compound. The organic solvent of the present invention is generally used in an amount of from 2 to 50 weight parts, preferably from 5 to 25 parts per 1 weight part of the diazo compound. It is preferable to apply the diazo compound in an amount of from 0.05 to 2.0 g/m$^2$.

In the case where the diazo compound, the coupling component or the coloring assistant used according to the present invention is not microencapsulated, it is preferable to use them in a condition of solid-dispersion, prepared by using a sand mill, or the like. In this case, the materials are separately dispersed in the individual solutions of the water soluble polymer. As the preferable water soluble polymer, the water soluble, polymers usable in preparing the microcapsules can be used. At this time, the concentration of the water soluble polymers is from 2 to 30 wt % and the diazo compound, the coupling component and the coloring assistant are incorporated into the solution in amounts so as to have concentrations of from 5 to 40 wt % relative to the solution of the water-soluble polymer.

It is preferable to select the size of dispersed particles to be not larger than 10 μm, more preferably not larger than 2 μm.

As the heat-sensitive recording material according to the present invention, for the purpose of preventing the material from sticking to the thermal head and of improving in a writing property, pigments such as silica, barium sulfate, titanium oxide, aluminum hydroxide, zinc oxide, calcium carbonate, or the like, and fine powder of styrene beads or urea-melamine resin, can be used.

Similarly, metal, soap, or the like, can be used to prevent sticking. The amount of such a material to be used is generally from 0.2 to 7 g/m$^2$.

Further, the heat-sensitive recording material according to the present invention can contain a heat fusible material in order to improve the density of thermal recording.

The heat fusible material may be a material which is solid at a room temperature and fused when heated by a thermal head at a melting point of 50° to 150° C. and which dissolves the diazo compound, the coupling components, or the coloring assistant. The heat fusible material is dispersed in the form of particles having a size of 0.1 to 10 μm and used in an amount of 0.2 to 7 g/m² of the solid basis. Specific examples of the heat fusible material include fatty acid amides, N-substituted fatty acid amides, ketone compounds, N-substituted carbamate compounds, urea compounds, esters, etc.

The heat-sensitive recording material according to the present invention can be applied by using a proper binder.

As the binder, polyvinyl alcohol, methyl cellulose, carboxymethyl cellulose, hydroxypropyl cellulose, gum arabic, gelatin, polyvinylpyrrolidone, casein, styrenebutadiene latex, acrylonitrile-butadiene latex, polyvinyl acetate, polyacrylic acid ester or ethylenevinyl acetate copolymer, may be used in the form of emulsion. The amount of the binder to be used is generally from 0.5 to 5 g/m² of the solid basis.

According to the present invention, as the acid stabilizer, for example, citric acid, tartaric acid, oxalic acid, boric acid, phosphoric acid, pyrophosphoric acid, etc., may be added to the raw materials as described above.

In the recording material according to the present invention, the diazo compound or the coupling component is dissolved or dispersed in the solvent and then microencapsulated. Remainder reactive material is solid-dispersed or made to be an aqueous solution thereof which is mixed with the dispersed solution of the microcapsule as described above so as to prepare a coating solution. The coating solution is applied onto a support such as a sheet of paper, a synthetic resin film, or the like, through a suitable coating such as bar coating, blade coating, air knife coating, gravure coating, roll coating, spray coating, dip coating, or the like, and the coated compositions is dried to provide a heat-sensitive recording layer at a dry coverage of 2.5 to 15 g/m². As another method, there is a superimposed arrangement such that the microcapsule layer containing the reactive material and the organic solvent, and the layer containing the remainder reactive material are superimposed one on the other. The superimposed arrangement is more advantageous than other arrangement in view of fog possibly occurring during long storage. In this case, as regards sensitivity, it is advantageous that the microcapsule layer is arranged upper, while in view of preventing of the color-forming fog due to destruction of the microcapsule due to pressure and friction in handling, it is advantageous to arrange the microcapsule layer as a lower layer.

The heat-sensitive recording material according to the present invention can be used as printer paper for a facsimile, a computer, or the like, in which high-speed recording is required and moreover the unreacted diazo compound thereof is decomposed by exposing after thermal printing has been effected to thereby fix the records printed. Also the material can be used as copy paper for a thermal development type copying machine.

Examples are described hereunder. However, the present invention is not limited to these examples. Unless otherwise indicated, all terms "part" used to represent an addition amount are by weight.

EXAMPLE 1

2 Parts of the diazo compound as illustrated hereunder and 18 parts of an addition product of xylylenediisocyanate and trimethylolpropane (3/1 in molar ratio) were added to a mixed solvent of 24 parts of dibutyl phthalate and 5 parts of ethyl acetate so as to be dispersed and dissolved. The resulting solution of the diazo compound was mixed with the aqueous solution prepared by dissolving 3.5 parts of polyvinyl alcohol and 1.7 parts of gelatin in 58 parts of water, and dispersed in an emulsified condition at 20° C. Thus, an emulsion of the oil droplet type in water having the average particle size of 3 μm was obtained. 100 Parts of water was added to the thus obtained emulsion and the resulting emulsion was heated at 60° C. while agitating them. After two hours the capsule solution containing the diazo compound and the dibutyl phthalate as the core material was obtained. The diazo compound is represented by the formula.

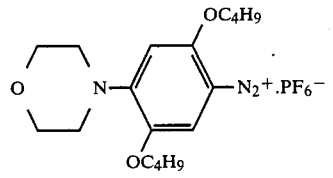

Next, 20 parts of 2-hydroxy-3-naphthoic acid anilide was added to 100 parts of a 5% polyvinyl alcohol aqueous solution and dispersed by a sand mill in about 24 hours to prepare a dispersion of the coupling component having an average particle size of 3 μm.

Separately, 20 parts of triphenylguanidine was added to 100 parts of a 5% polyvinyl alcohol aqueous solution and dispersed using a sand mill for about 24 hours to prepare a dispersion of triphenylguanidine having an average particle size of 3 μm.

Further, 20 parts of p-tert-butylphenol was added to 100 parts of a 5% polyvinyl alcohol aqueous solution and dispersed using a sand mill for about 24 hours to prepare a dispersion of the p-tert-butylphenol having an average particle size of 3 μm.

1 Part of a 5% hydroquinone aqueous solution, 15 parts of the dispersion of the coupling component, 15 parts of the dispersed material of the triphenyl guanidine and 30 parts of the dispersed material of the p-tert-butylphenol were added to 50 parts of the capsule solution of the diazo compound obtained as described above, so as to form a coating solution. The coating solution was coated by a bar coating method onto a smooth wood free paper of fine quality (having a basis weight of 50 g/m²) by using a coating rod, in an amount of 20 g/m² (dry weight) and dried at 45° C. for 30 minutes to produce a heat-sensitive recording material.

EXAMPLE 2

A heat-sensitive recording material was obtained in the same manner as in Example 1, except that tricresyl phosphate was used in place of the dibutyl phthalate used in the Example 1.

EXAMPLE 3

A heat-sensitive recording material was obtained in the same manner as in Example 1, except that a mixture of tricresyl phosphate and trimethylolpropane trimethacrylate (3/1 in weight ratio) was used in place of the dibutyl phthalate used in the Example 1.

COMPARATIVE EXAMPLE 1

A heat-sensitive recording material was obtained in the same manner as in Example 1 except that diethyl phthalate was used in place of the dibutyl phthalate used in the Example 1.

COMPARATIVE EXAMPLE 2

A heat-sensitive recording material was obtained in the same manner as in Example 1 except that dimethyl phthalate was used in place of the dibutyl phthalate used in the Example 1.

COMPARATIVE EXAMPLE 3

A heat-sensitive recording material was obtained in the same manner as in Example 1 except that the following material was used in place of the dibutyl phthalate used in the Example 1.

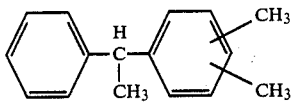

COMPARATIVE EXAMPLE 4

A heat-sensitive recording material was obtained in the same manner as in Example 1 except that dioctyl phthalate was used in place of the dibutyl phthalate used in the Example 1.

Test Methods

Thermal recording was performed onto the heat-sensitive recording materials which have been obtained in the Examples 1 to 3 as well as in the Comparative Examples 1 to 4, by using a GIII Mode (Hifax 700, produced by HITACHI Ltd.) and exposed all over the surface thereof by using RICOPY SUPER DRY 100 (produced by RICOH Co., Ltd.) so as to be fixed. Blue density of the thus obtained recorded image was measured by using a Macbeth reflection densitometer. The results are as shown in Table 1. Further, thermal recording was performed again onto the fixed portion and the result proved that no colored image was recorded and therefore the fixing was made completely.

The background concentration (that is fog) of the heat-sensitive recording material was measured by using a Macbeth reflection densitometer before thermal-recording was effected. The results are as shown in Table 1.

The Table 1 shows that fog was low in each of the heat-sensitive recording materials obtained in Examples 1 to 3 according to the present invention, while being high in each of the heat-sensitive recording materials obtained in the Comparative Examples 1 to 4, and thus proves that the present invention is superior.

TABLE 1

| | Organic Solvent | | | |
|---|---|---|---|---|
| Example No. | Kind | Dielectric Constant | Fog | Colored Image |
| Example 1 | dibutyl phthalate | 6.4 | 0.07 | 1.15 |
| Example 2 | tricresyl phosphate | 7.3 | 0.09 | 1.15 |
| Example 3 | mixture of tricresyl phosphate and trimethylol propane trimethacrylate (3/1 in weight ratio) | 5.5 | 0.09 | 1.10 |
| Comparative Example 1 | diethyl phthalate | 7.6 | 0.72 | 1.15 |
| Comparative Example 2 | dimethyl phthalate | 8.5 | 1.10 | 1.15 |
| Comparative Example 3 | 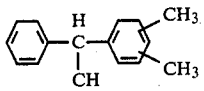 | 2.5 | 0.61 | 0.79 |
| Comparative Example 4 | dioctyl phthalate | 5.1 | 0.44 | 0.85 |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a recording layer containing a diazo compound and a coupling component, wherein said diazo compound is contained in microcapsules together with an organic solvent having a dielectric constant of from 5.2 to 7.5.

2. A heat-sensitive recording material as in claim 1, wherein the organic solvent has a dielectric constant of from 5.5 to 7.4.

3. A heat-sensitive recording material as in claim 1, wherein the organic solvent has a dielectric constant of from 6 to 7.

4. A heat-sensitive recording material as in claim 1, wherein the recording layer additionally contains a coloring assistant.

5. A heat-sensitive recording material as in claim 4, wherein the coloring assistant is microencapsulated.

6. A heat-sensitive recording material as in claim 4, wherein the amounts of the coupling component and the coloring assistant are from 0.1 to 10 weight parts and from 0.1 to 20 weight parts, respectively, per one weight part of the diazo compound.

7. A heat-sensitive recording material as in claim 1, wherein said organic solvent is used in an amount of from 5 to 25 weight parts per one weight part of the diazo compound.

8. A heat-sensitive recording material as in claim 1, wherein said diazo compound is applied in an amount of from 0.05 to 2.0 g/m$^2$.

* * * * *